US006598838B2

(12) United States Patent
Suh

(10) Patent No.: US 6,598,838 B2
(45) **Date of Patent: *Jul. 29, 2003**

(54) ADJUSTABLE BABY BOTTLE HOLDER

(75) Inventor: Simon Suh, Fullerton, CA (US)

(73) Assignee: E-Z Baby Products LLC, Hacienda Heights, CA (US)

( * ) Notice: Subject to any disclaimer, the term of this patent is extended or adjusted under 35 U.S.C. 154(b) by 61 days.

This patent is subject to a terminal disclaimer.

(21) Appl. No.: 09/847,498

(22) Filed: May 2, 2001

(65) Prior Publication Data

US 2002/0162918 A1 Nov. 7, 2002

(51) Int. Cl.[7] ..... A47D 15/00

(52) U.S. Cl. ..... 248/104; 248/102; 248/103; 248/105; 248/106; 248/107

(58) Field of Search ..... 248/102, 103, 248/104, 105, 106, 229.14, 220.22, 214, 231, 61

(56) References Cited

U.S. PATENT DOCUMENTS

| | | | | | |
|---|---|---|---|---|---|
| 1,688,765 | A | * | 10/1928 | Veras | 248/103 |
| 1,753,875 | A | * | 4/1930 | Baumann | 248/103 |
| 1,786,459 | A | * | 12/1930 | Simons | 248/104 |
| 4,114,847 | A | * | 9/1978 | Bogensberger | 248/104 |
| 5,032,015 | A | * | 7/1991 | Christianson | 138/118 |
| 5,083,732 | A | * | 1/1992 | Akamine | 248/104 |
| 5,135,189 | A | | 8/1992 | Ghazizadeh | 248/104 |
| 5,192,041 | A | | 3/1993 | Bryant | 248/104 |
| 5,489,075 | A | | 2/1996 | Ible | 248/104 |
| 5,664,746 | A | | 9/1997 | Benzakarya | 248/106 |
| 5,704,505 | A | * | 1/1998 | Singh | 215/11.1 |
| 5,823,486 | A | * | 10/1998 | Smith et al. | 248/103 |
| 5,873,551 | A | | 2/1999 | Jones | 248/102 |
| 6,003,821 | A | | 12/1999 | Fabian et al. | 248/104 |
| 6,250,592 | B1 | * | 6/2001 | Davis | 248/102 |
| 6,386,490 | B1 | * | 5/2002 | Suh | 248/102 |

FOREIGN PATENT DOCUMENTS

| | | | |
|---|---|---|---|
| FR | 343855 | * | 10/1904 |

* cited by examiner

*Primary Examiner*—Leslie A. Braun
*Assistant Examiner*—Deborah M. Brann
(74) *Attorney, Agent, or Firm*—Fulbright & Jaworski L.L.P.

(57) ABSTRACT

An adjustable baby bottle holder includes a rotating member. A top bar is rotatably attached to the rotating member. A bottom bar is attached to the top bar and a grasping member is rotatably attached to the bottom bar. The top bar and the bottom bar are generally perpendicular to each other. Two principle directions of movement are provided. First, the top bar rotates circumferentially within the rotating member. Second, the grasping member rotates circumferentially about the bottom bar in a generally perpendicular orientation to the top bar.

11 Claims, 4 Drawing Sheets

ADJUSTABLE BABY BOTTLE HOLDER

BACKGROUND

The present invention relates to a baby bottle holder for holding a baby bottle providing hands free feeding of an infant. More particularly the present invention pertains to devices that are attached to cribs or strollers that allow the baby bottle to remain in or near the baby's mouth without the continuous assistance of an attendant.

Devices for holding a baby bottle are well known in the art. Many provide hands free feeding of babies. U.S. Pat. No. 6,003,821 by Fabian describes a decorative holder for a baby bottle in which a flexible arm with a bottle receiver connected to one end and a clamp is connected to the other end. U.S. Pat. No. 5,489,075 describes a baby bottle holder and feeder utilizing an articulating arm and a clamping member. U.S. Pat. No. 5,664,746 by Benzakarya relates to a weighted base containing a rotating ball and a movable first arm.

Most of the prior art devices are restricted in some direction of their movement. Unfortunately, the prior art devices are typically designed to be positioned by an adult, but they are not flexible enough with minimal friction to move with the child's mouth. Flexible arms are often used to position the bottle near the child.

The flexible arms must be rigid enough to hold the weight of the bottle, as such, they are often too rigid to allow a young baby to move the bottle themselves just by the strength of their own head movement.

The prior art devices show that there is a need for an adjustable baby bottle holder that has multiple directions of low resistance movement, which allow the bottle to remain in the baby's mouth even with head movement by the baby. The bottle needs to stay in the baby's mouth even with head movement side to side or up and down head movement.

An objective of the present invention, an adjustable baby bottle holder, is to provide multiple directions of low resistance rotational movement. The movement by the baby bottle holder in multiple spatial directions allows the bottle to remain in the baby's mouth despite head movement by the baby. Directions of head movement side-to-side or up and down can all be accommodated by the invention.

Another objective of the adjustable baby bottle holder is to allow an interchangeability of grasping members to accommodate baby bottles of differing circumference.

An adjustable baby bottle holder includes a rotating member. A top bar is rotatably attached to the rotating member. A bottom bar is attached to the top bar and a grasping member is rotatably attached to the bottom bar.

The grasping member has a force fit snap-on mechanism that allows the grasping member to attach to the bottom bar. The top bar and the bottom bar are generally perpendicular to each other. A flexible arm member with an attachment end and a joint end, attaches to the rotating member at the joint end.

The top bar and bottom bar are connected by a front bar and a back bar. The top bar has a first end and a second end. The bottom bar has a third end and a fourth end. The front bar attaches to the first end and the third end. The back bar attaches to the second end and the fourth end. The front bar and the back bar can twist to form the generally perpendicular orientation of the top bar and the bottom bar, such that there are two directions of freedom of rotation for the baby bottle. The front bar and the back bar can be symmetrical or may vary in shape from each other.

In a second embodiment of the invention the rotating member has a hooking bar. The top bar has a through hole. The through hole receives the hooking bar. A front bar and a back bar connect the top bar and the bottom bar. The grasping member rotatably attaches to the bottom bar. The top bar and the bottom bar are generally perpendicular to each other. The flexible arm member attaches at the joint end to the rotating member.

The adjustable baby bottle holder can also include a first loop, and a second loop attached to the first loop. The first loop is attached to the top bar and the second loop is connected to the bottom bar. The front bar and the back bar can be separated by a distance "d". "d" gradually increases from about zero at the ring member to a maximum distance "d" at about the grasping member. The top bar is a cylindrical tube having a hollow channel.

The grasping member is designed to hold a baby bottle. The flexible arm can be secured at the attachment end to an object, such as a baby crib, then moved and positioned such that the baby bottle is near the mouth of the baby. The baby bottle can move with the baby and remain in the baby's mouth.

A first direction of flexible movement is the circumferential rotation of the top bar in relation to the rotating member. A second direction of flexible movement is also available with the grasping member rotatably attached to the rotating member. When the baby is sitting upright and rocks his or her head side to side, then this circumferential rotation keeps the bottle in contact with the baby's mouth.

The grasping member has one or more fingers that are a semicircle shape about the same diameter as the bottle that the grasping member is designed to hold. The fingers of the grasping member clasp about the baby bottle. The snap-on mechanism is designed so that the grasping member is removably attached to the rotating member. The grasping member may be interchanged with a second grasping member that has fingers that are of differing diameter than the grasping member, such that different size baby bottles can be held.

With the adjustable arm the bottle can easily be tilted upward to prevent leaking of fluids from the nipple. This advantage applies when the baby is taking a short break from feeding and the bottle is temporarily not in use. The feature is also advantageous when the baby falls asleep while feeding where the bottle will remain generally in its established position and not lay with the nipple pointed downward prone to leaking. The adjustable baby bottle holder is further described and illustrated in the accompanying description and figures.

DESCRIPTION

Figure 1:
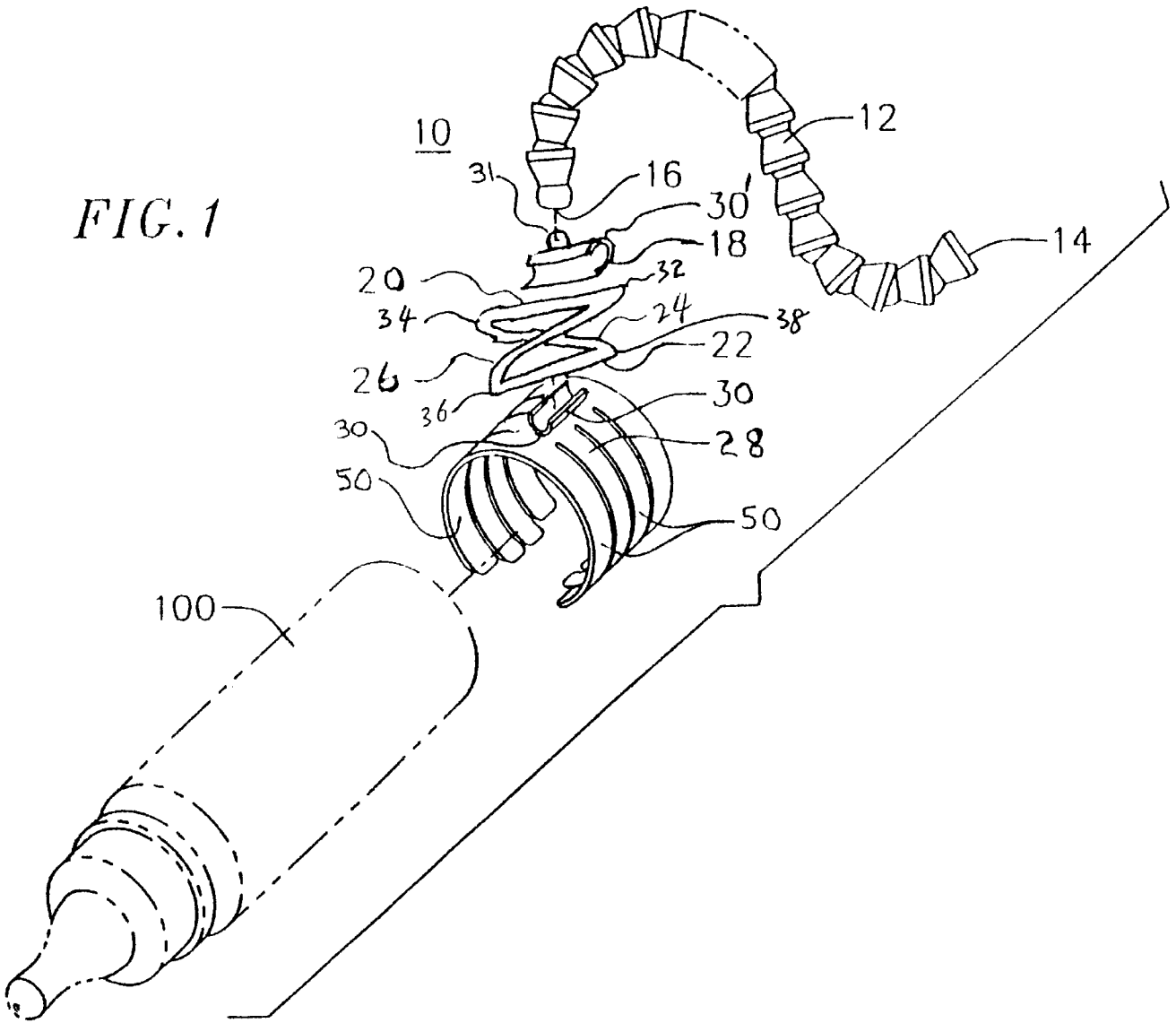
FIG. 1 is an exploded perspective view of a first embodiment of the adjustable baby bottle holder 10.
Figure 3:
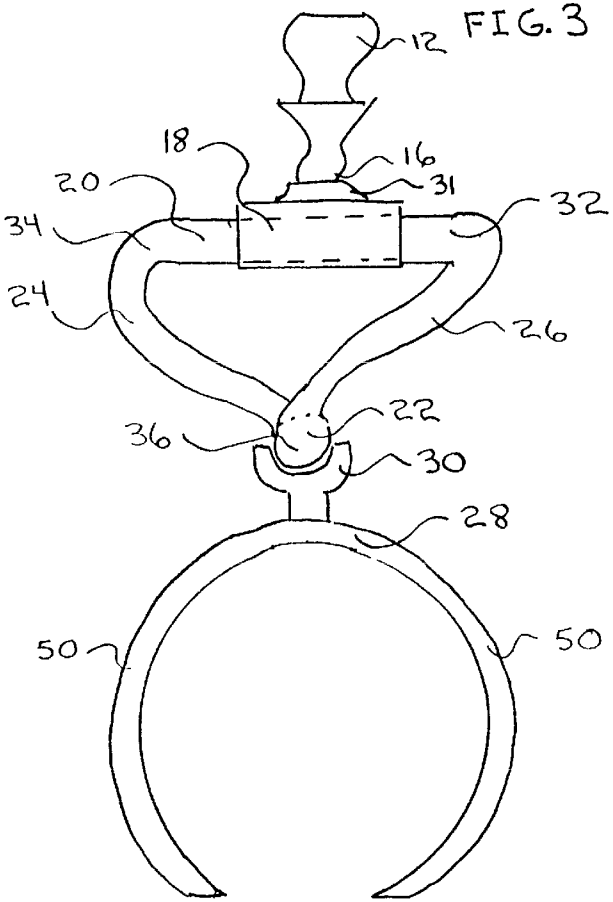
FIG. 3 is a front view of the first embodiment of the invention including the grasping member.
Figure 2:
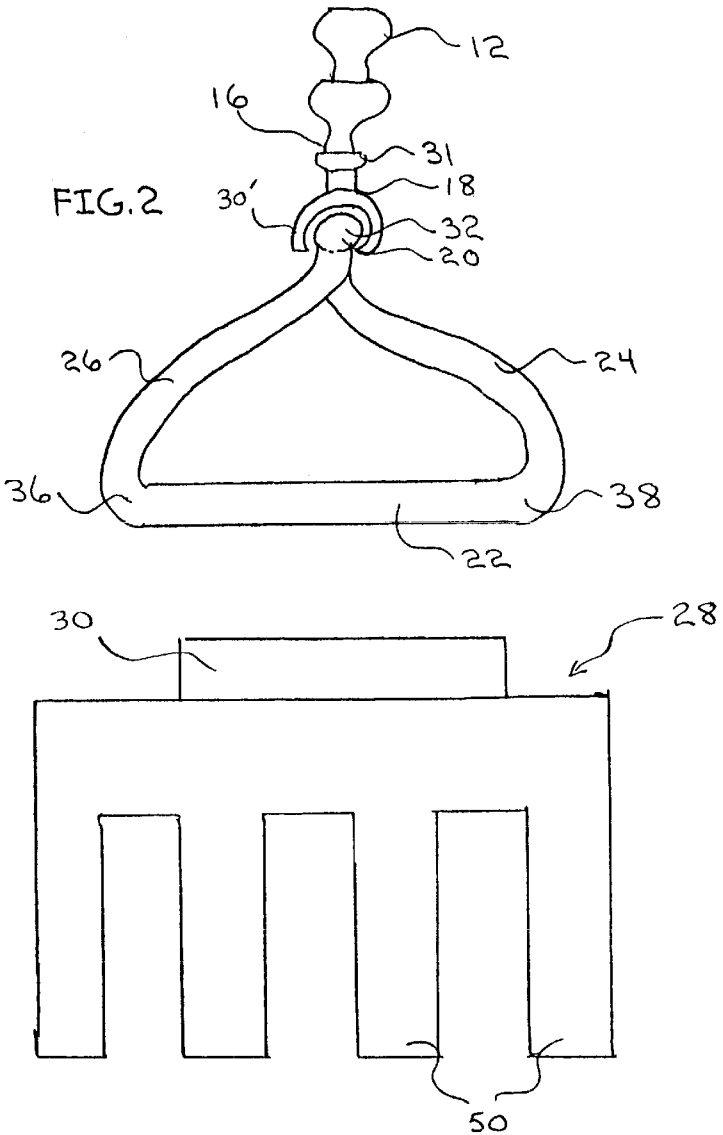
FIG. 2 is an exploded side view of the first embodiment of the invention including the grasping member.

Referring to FIGS. 1–3, particularly to FIG. 1 that is an exploded perspective view of the adjustable baby bottle holder 10, an adjustable baby bottle holder 10 includes a flexible arm member 12 having an attachment end 14 and a joint end 16. A rotating member 18 is attached to the joint end 16 of the flexible arm member 12. A top bar 20 is rotatably attached to the rotating member 18. A bottom bar 22 is attached to the top bar 20. The bottom bar 22 and the top bar 20 are substantially cylindrical in shape.

This embodiment in FIG. 1 shows the bottom bar 22 attached to the top bar 20 by a back bar 24 and a front bar 26. A grasping member 28 is rotatably attached to the bottom bar 22. The grasping member 28 has a force fit snap-on mechanism 30 that allows the grasping member 28 to rotatably attach to the bottom bar 22. The flexible arm member 12 is attached at the joint end 16 to the rotating member 18. A nodule 31 located on the rotating member 18 snaps into the joint end 16 of the flexible arm member 12.

The top bar 20 and the bottom bar 22 are generally perpendicular to each other. The top bar 20 and bottom bar 22 are connected by the front bar 26 and the back bar 24. The top bar 20 further has a first end 32 and a second end 34. The bottom bar 22 has a third end 36 and a fourth end 38. The front bar 26 attaches to the first end 38 and the third end 36. The back bar 24 attaches to the second end 34 and the fourth end 38. The front bar 26 and the back bar 24 can twist to form the generally perpendicular orientation of the top bar 20 and the bottom bar 22, such that there are two directions of freedom of rotation for the baby bottle 100. The front bar 26 and the back bar 24 can be symmetrical or may vary in shape from each other.

FIG. 2 is an exploded side view of the first embodiment of the invention. The flexible arm member 12 attaches at the joint end 16 to the nodule 31 of the rotating member 18. The top bar 20 is rotatably attached within the rotating member 18. The rotating member 18 has a force fit snap-on mechanism 30'. The grasping member 28 also has a force fit snap-on mechanism 30 that attaches to the bottom bar 22. The top bar 20 and the bottom bar 22 are generally perpendicular to each other. The top bar 20 and bottom bar 22 are connected by the front bar 26 and the back bar 24. The front bar 26 attaches to the first end 32 of the top bar 20 and the third end 36 of bottom bar 22. The back bar 24 attaches to the second end 34 of the top bar 20 and the fourth end 38 of bottom bar 22. The second end 34 of the top bar 20 is hidden from view.

The front bar 26 and the back bar 24 are twisted. Two principle directions of movement are provided. First, the top bar 20 rotates circumferentially within the rotating member 18. Second, the force fit snap-on mechanism 30 on the grasping member 28 rotates circumferentially about the bottom bar 22 in a generally perpendicular orientation to the top bar 20.

FIG. 3 is a front view of the details shown in FIG. 2. The twisting and generally perpendicular orientation of the top bar 20 and bottom bar 22 are apparent from the two views. FIG. 3 is not an exploded view, thus FIG. 3 shows the force fit snap-on mechanism 30 of the grasping member 28 connected to the bottom bar 22. The first end 32 and second end 34 of the top bar 20 can be readily seen as they protrude from the rotating member 18. The third end 36 of the bottom bar 22 is shown, while the fourth end 38 is hidden from view. The fingers 50 of the grasping member 28 partially encircle and grasp a baby bottle 100.

Figure 5:
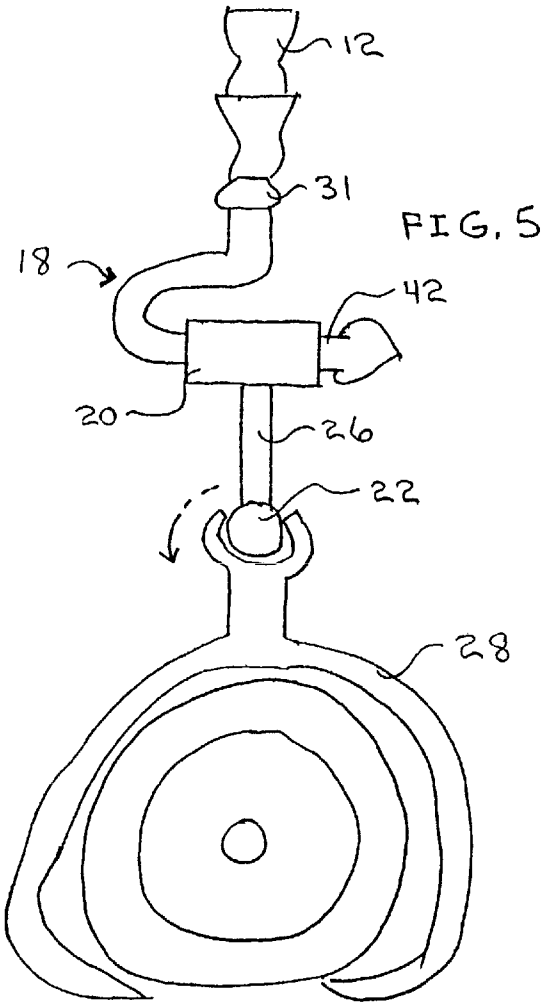
FIG. 5 is a front view of the second embodiment.
Figure 4:
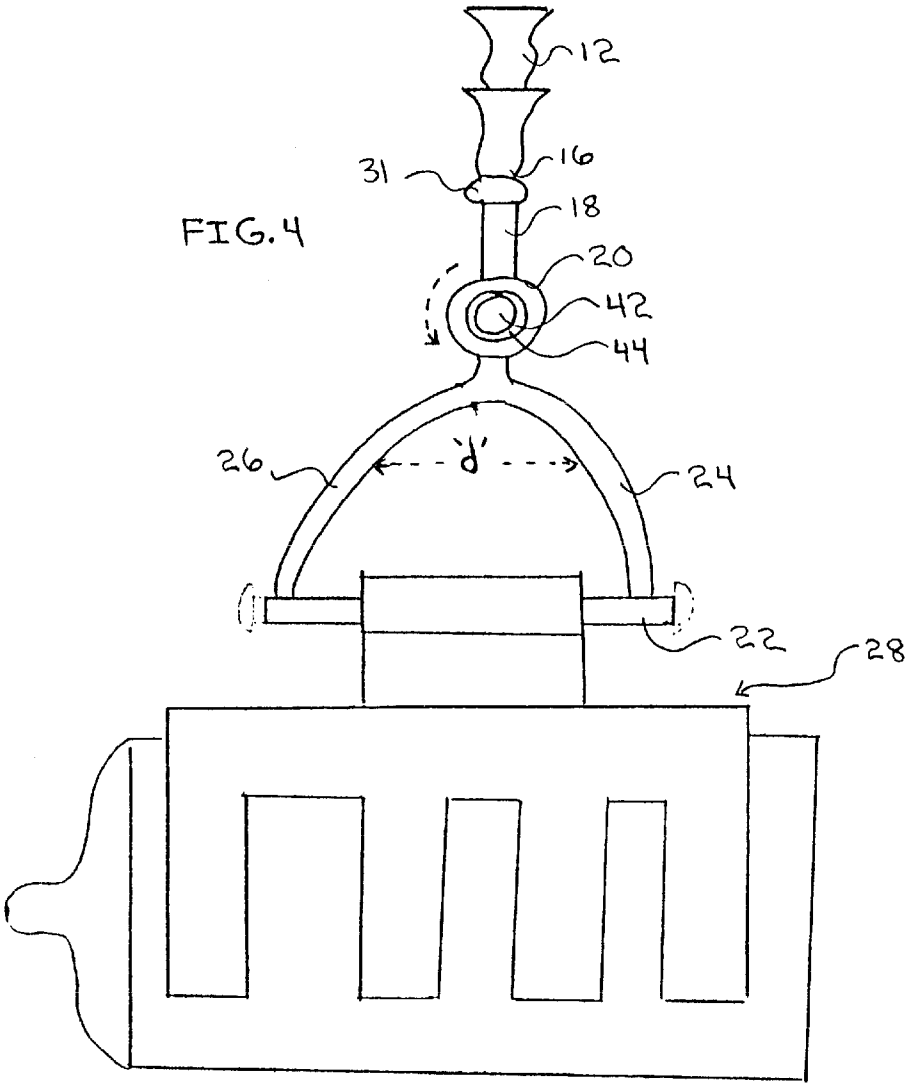
FIG. 4 is a side view of a second embodiment including the rotating member with a hooking bar and the top bar with a through hole.

Referring to FIG. 4 and FIG. 5, a second embodiment of the invention is illustrated. The rotating member 18 has a hooking bar 42. A top bar 20 has a through hole 44. The through hole 44 receives the hooking bar 42. The top bar 20 is a cylindrical tube with the through hole 44. The top bar 20 and the bottom bar 22 are connected by the front bar 26 and the back bar 24. The top bar 20 with the through hole 44 and the bottom bar 22 are generally perpendicular to each other. The bottom bar 22 rotatably attaches to the grasping member 28. The grasping member 28 has fingers 50 that grasp the baby bottle 100. The flexible arm member 12 attaches to the rotating member 18 at the joint end 16. The front bar 26 and the back bar 24 are separated by a distance "d". "d" gradually increases from about zero at the top bar 20 to a maximum distance "d" at about the bottom bar 22.

Directional arrows indicate two directions of movement. First, is circumferential rotation between the top bar 20 and the rotating member 18. Second, is circumferential rotation of the grasping member 28 about the bottom bar 22. A third direction of movement is possible with the rotation of the nodule 31 of the rotating member 18 within the joint end 16 of the flexible arm member 12. The third direction of movement, rotation of the nodule 31, can be easy so that the baby's actions will create the movement. Conversely, the connection between the joint end 16 and the nodule 31 can be slightly firm, so that actions of an adult are required to create the rotational movement. Additionally, the flexible arm member 12 can be adjusted to different locations.

In this second embodiment the rotating member 18 has a hooking bar 42. The top bar 20 has a through hole 44. The through hole 44 of the top bar 20 accepts the hooking bar 42 of the rotating member 18 so that the hooking bar can rotate freely within. In the first embodiment, shown in FIGS. 2 and 3, the rotating member 18 partially encircles the top bar 20 from above. In both embodiments the rotating member 18 has a nodule 31 that attaches to the joint end 16 of the flexible arm. The top bar 20 and the bottom bar 22 are connected by the front bar 26 and back bar 24, as in the first embodiment.

Figure 6:
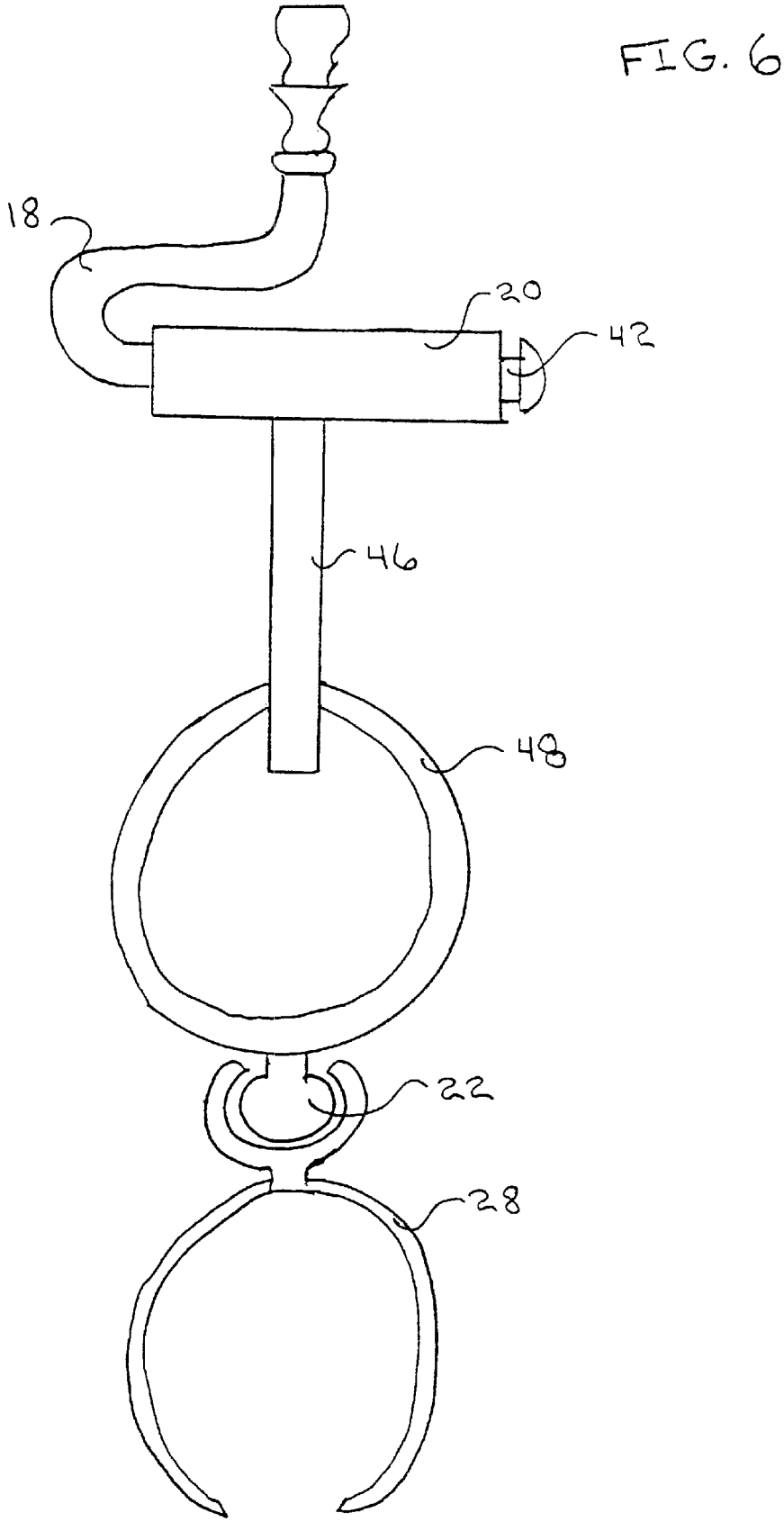
FIG. 6 illustrates the second embodiment with a first loop attached to the top bar and a second loop attached to the bottom bar.

Referring to FIG. 6, a variation of the second embodiment is shown. A first loop 46 is included that is attached to the top bar 20. A second loop 48 is connected to the first loop 46. The bottom bar 22 is attached to the second loop 48. The first loop 46 and second loop 48 replace the front bar 26 and the second bar, with regard to the function of connecting the top bar 20 and the bottom bar 22. The grasping member 28 rotatably attaches to the bottom bar 22. The fingers 50 of the grasping member 28 encircle the baby bottle 100. The baby bottle 100 is not shown.

Referring to FIGS. 1, 4 and 5, the grasping member 28 is designed to hold a baby bottle 100. The flexible arm 12 can be secured at the attachment end 14 to an object, such as a baby crib or stroller, then moved and positioned such that the baby bottle 100 is near the mouth of the baby. The baby bottle 100 can move with the baby and remain in the baby's mouth since there are two directions of flexible movement. A first direction of flexible rotational movement is available with the top bar 20 rotating circumferentially to the rotating member 18. A second direction of flexible movement is also available with the grasping member 28 rotatably attached to the bottom bar 22. The force fit snap-on mechanism 30 allows the grasping member 28 to perform the circumferential rotation movement about the bottom bar 22. When the baby is sitting upright and rocks her head side to side this circumferential rotation keeps the baby bottle 100 in contact with the baby's mouth.

The grasping member 28 has one or more fingers 50 that are a semicircle shape about the same diameter as the bottle 100 that the grasping member 28 is designed to hold. The fingers 50 of the grasping member 28 clasp about the baby bottle 100. The force fit snap-on mechanism 30 is designed so that the grasping member 28 is removably attached to bottom bar 22.

Although not illustrated, the grasping member 28 may be interchanged with a second grasping member 28 that has fingers 50 that are of differing diameter than the original grasping member 28, such that different size baby bottles 100 can be held.

Although the present invention has been described in considerable detail with regard to the preferred versions thereof, other versions are possible. Therefore, the appended claims should not be limited to the descriptions of the preferred versions contained herein.

What is claimed is:

1. An adjustable baby bottle holder comprising:

a) a rotating member;

b) a top bar rotatably attached to the rotating member;

c) a bottom bar attached to the top bar; and d) a grasping member rotatably attached to the bottom bar; wherein the top bar and the bottom bar are generally perpendicular to each other.

2. The adjustable baby bottle holder of claim 1 further comprising a flexible arm member having an attachment end and a joint end, wherein the rotating member is attached to the joint end.

3. The adjustable baby bottle holder of claim 2 further having a front bar and a back bar, wherein the top bar further having a first end and a second end, wherein the bottom bar further having a third end and a fourth end, wherein the front bar attaches to the first end and the third end, wherein the back bar attaches to the second end and the fourth end.

4. The adjustable baby bottle holder of claim 3 wherein the front bar and the back bar twist to form the generally perpendicular orientation of the top bar and the bottom bar, such that there are two directions of freedom of rotation for the baby bottle.

5. The adjustable baby bottle holder of claim 4 wherein the front bar and the back bar are symmetrical.

6. The adjustable baby bottle holder of claim 5 wherein the grasping member further having a force fit snap-on mechanism, wherein the grasping member is attached to the bottom bar by the force fit snap-on mechanism.

7. An adjustable baby bottle holder comprising:

a) a rotating member having a hooking bar;

b) a top bar having a through hole, wherein the through hole receives the hooking bar;

c) a bottom bar attached to the top bar; and d) a grasping member rotatably attached to the bottom bar, wherein the top bar and the bottom bar are generally perpendicular to each other.

8. The adjustable baby bottle holder of claim 7 further comprising a flexible arm member having an attachment end and a joint end, wherein the rotating member is attached to the joint end.

9. The adjustable baby bottle holder of claim 8 wherein the rotating member further having a nodule, wherein the nodule is rotatably attached to the joint end of the flexible member.

10. The adjustable baby bottle holder of claim 9 further having a first loop and a second loop attached to the first loop, wherein the first loop is attached to the top bar and the second loop is connected to the bottom bar.

11. The adjustable baby bottle holder of claim 10 wherein the top bar is a cylindrical tube.

* * * * *